US007618360B2

(12) United States Patent
Daher et al.

(10) Patent No.: US 7,618,360 B2
(45) Date of Patent: Nov. 17, 2009

(54) BASE INSERT DEVICE FOR PAPER BAGS

(75) Inventors: Marco Daher, Wallenhorst (DE); Uwe Koehn, Osnabrueck (DE); Andreas Lamkemeyer, Osnabrueck (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/563,860

(22) PCT Filed: Jul. 5, 2004

(86) PCT No.: PCT/EP2004/007298

§ 371 (c)(1),
(2), (4) Date: Jan. 9, 2006

(87) PCT Pub. No.: WO2005/002837

PCT Pub. Date: Jan. 13, 2005

(65) Prior Publication Data

US 2006/0229179 A1 Oct. 12, 2006

(30) Foreign Application Priority Data

Jul. 7, 2003 (DE) ..... 103 30 750

(51) Int. Cl.
*B31B 1/62* (2006.01)

(52) U.S. Cl. ..... 493/264; 493/218; 493/221; 493/276; 493/285; 493/331; 118/315; 118/324; 118/410; 222/319; 222/336; 222/410; 222/485; 222/550

(58) Field of Classification Search ..... 493/218, 493/219, 221, 264, 276, 285, 331, 334; 118/315, 118/324, 325, 410; 156/578; 222/319, 330, 222/336, 410, 485, 550
See application file for complete search history.

(56) References Cited

U.S. PATENT DOCUMENTS 3,286,689 A * 11/1966 Ziemba ..... 118/411
4,156,398 A * 5/1979 McDaniel ..... 118/704

(Continued)

FOREIGN PATENT DOCUMENTS

DE 1 229 828 B 12/1966

(Continued)

*Primary Examiner*—Hemant M Desai
(74) *Attorney, Agent, or Firm*—Jacobson Holman PLLC

(57) ABSTRACT

The present invention relates to a base insert device for crossed base valve bags for the formation of crossed bases in paper bags, by means of folding devices which introduce folds at the ends of the tubular sections from which the bags are produced, with one or more gluing stations, which apply glue to the regions of the folds for gluing and/or the sheets (5) provided for gluing to the base, in the gluing stations and at least one pressing station in which the folded bases and the sheets (5) are brought into contact and glued.

The novelty of the present patent application is that at least one gluing station for the sheets and/or bases is provided, comprising glue outlet openings (22) which may be selectively supplied with glue, whereby the selection of the glue outlet openings (22) defines the format of the glue application (6, 7, 8, 9). Said glue outlet openings (22) are provided with at least two application heads (1) of which at least one application head (1) may be displaced in a direction (y) orthogonal to the feed direction of the sheets (5) and/or the folded bases such that as a result of the displacement, a relative movement of the two application heads (1) occurs.

18 Claims, 7 Drawing Sheets

U.S. PATENT DOCUMENTS 4,157,149 A * 6/1979 Moen ..... 222/486
4,488,665 A * 12/1984 Cocks et al. ..... 222/146.5
4,687,137 A * 8/1987 Boger et al. ..... 239/124
5,000,112 A * 3/1991 Rothen et al. ..... 118/411
5,044,873 A * 9/1991 Vijuk ..... 414/792.5
5,647,948 A * 7/1997 Paridis ..... 156/578
5,913,764 A * 6/1999 Kolbe et al. ..... 493/218
6,475,283 B1 11/2002 Koehn
6,689,214 B2 2/2004 Burmester et al.
6,805,660 B1 * 10/2004 Finch ..... 493/218
6,955,722 B2 * 10/2005 Ackerman ..... 118/315

FOREIGN PATENT DOCUMENTS

DE 28 34 441 2/1979
DE 3020043 12/1981
DE 35 06 393 A1 8/1986
DE 90 14 548 U1 1/1991
DE 299 08 150 U1 8/1999
DE 199 35 117 A1 2/2001
DE 103 09 893 A1 4/2004

* cited by examiner

BASE INSERT DEVICE FOR PAPER BAGS

This is a nationalization of PCT/EP04/007298 filed Jul. 5, 2004 and published in German.

BACKGROUND OF THE INVENTION

1. Field of Invention

The present invention relates to a base insert device for paper bags. The apparatus has folding devices, gluing stations that apply glue to the regions of the folds and/or to sheets provided for gluing to the base, and a pressing station in which the folded bases and the sheets are brought into contact and adhered to one another.

2. Description of the Prior Art

Devices of this type are used in the production of various types of bags. These bags include, for example, the so-called valve bags in which valve patches are usually inserted when manufacturing the bases of the bags. The bases are frequently designed as crossed bases as illustrated, for example in the patent applications DE 090 145 48 U1 and DE 3020043 A1. In order to provide the bases and the inserted valve patches with a lasting cohesion, parts of the bases are stuck one below the other and/or to the valve patches with the help of glue.

For this purpose, glue is applied to either the regions of the base folds to be glued or the sheets provided to them, thus all the regions that are to be glued to one another and these are subsequently glued to one another by merging them or folding them together.

A format-specific glue application usually takes place in the following manner: A format part attached on a rotating roller is brought into contact during the rotation of said roller with a glue roller or with other glue storing components or transfer components and is thus supplied with glue. In the further course of the rotation of the roller, the format plate transfers the glue stored on it onto each region of the subsequently formed bases of the bags or the sheets to be glued. For this purpose, the format part is provided with characteristic ridges that are adapted to a definite bag format. The format parts are replaced for producing bags having other formats on the base insert device. This type of glue application has stood the test of time since it enables the clean and format-specific application of large quantities of the starch glue, which is otherwise difficult to handle.

The words "format-specific glue application" refers toga form of application that is adapted to the type and the format of the bag. In this form of application, the glue is usually applied in a flat manner, whereby special significance is accorded to the edges of the form for the durability and the impermeability of the bags.

However, the disadvantage is that this method of glue transfer makes it necessary to provide and subsequently clean a plurality of glue transfer components, for instance the format rollers and the format parts.

Therefore the object of the present invention is to further improve the design of the base insert device in such a way that these glue transfer components can be totally omitted or at least reduced in number while still enabling a format-specific glue application.

The present invention is based on the well-known base insert devices, which exclusively comprise gluing stations that require format parts for defining the format of the glue application.

SUMMARY OF THE INVENTION

The above-mentioned object is achieved by a base insert device comprising at least one gluing station for sheets and/or bases

- that comprises glue outlet openings, which may be selectively supplied with glue, whereby the selection of the glue outlet openings defines the format of the glue application,
- whereby said glue outlet openings are provided with at least two application heads
- of which at least one application head may be displaced in a direction orthogonal to the feed direction of the sheets and/or the folded bases, such that, as a result of the displacement, a relative movement of the two application heads occurs.

The first subsection of the characterizing part deals with the definition of the glue application by extruding glue from glue outlet nozzles that can be selectively supplied with glue. By opening and closing glue valves, it is possible to determine which glue outlet openings are to be supplied with glue and which are not. The manner in which the glue profile is formed is described in the unpublished patent application DE 103 09 893. However, unlike the patent application mentioned above, the present invention also comprises devices, which do not extrude the glue directly onto the bag components. Rather these devices first provide the glue profile to another machine component such as a roller and then transfer it onto the bag components.

The afore-mentioned valves are usually connected to one or more glue supplying lines or glue reservoirs in which the glue is exposed to pressure.

Application heads as set forth in the present invention are machine components, which are provided with glue outlet openings. These application heads usually contain a plurality of openings, are provided with glue supplying lines and also support a large number of valves. If a gluing station has only one application head, then the distance of the glue outlet openings in the direction perpendicular to the feed direction of the sheets or the tubular sections is decisive for the precision with which random glue profiles can be reproduced. However, due to the above-mentioned functions of an application head, this distance cannot be reduced randomly. If two or more application heads are provided whose relative positions in the direction perpendicular to the feed direction of the sheets or the tubular sections can be changed, then the possibility of the format-specific glue application improves considerably. In this connection, it is particularly important to supply the edges of the sheets and/or regions of the bases of the bags to be glued with sufficient quantities of glue.

It is advantageous to provide every application head with an application plate in which several glue outlet openings are arranged equidistantly in each case on one line in the direction perpendicular to the feed direction of the sheets and/or the folds of the bases. The application plates are arranged in such a way that the adjoining glue outlet openings of two different application heads can take up a distance that is smaller than the described equidistant distance. This is feasible if the application plates are arranged on the application heads such that they can be displaced easily. For example, in case of three application heads, the application plate can be attached centrally to the middle application head, whereas the application plates can be attached to the outer application heads in such a way that they can easily move towards the middle application head. In this manner it is possible that when the outer application heads are moved outwards, there is no large distance between the glue outlet openings at the borders of the adjoining application heads and thus between the subsequently formed glue traces. An excessively large distance could result in an insufficient glue application.

In a preferred embodiment of the present invention, means are provided for automatically displacing at least one application head and also a control unit, which controls the displacement. In this manner it is possible to prevent a manual displacement of the application heads, due to which the described gluing stations can be built with a more compact design.

It is advantageous if the target image of the glue application is supplied to the control unit and if the control unit has means to calculate the target positions of the glue traces to be extruded from the glue outlet openings based on this target image. The target image can be supplied externally to the control unit, for example by manual entry or from a memory that can contain a large number of such target images. The control unit can control the displacement of the application heads based on the target positions of the glue traces on the sheet and/or of the base region to be glued where said target positions are calculated based on the target image.

It is advantageous to provide position sensors, which record the actual position at least of one spindle and notify the control unit. With the actual position of the spindle, simultaneously the actual position of the application heads, thus their relative position to the machine components transporting the sheets or the bases also becomes known. By comparing the target position and actual position of the application heads, it is possible to ensure an error-free positioning of the application heads.

In another embodiment of the present invention, a common glue supplying line is provided from which all the application heads of the gluing station are supplied with glue. A common glue supplying line as set forth in the present invention means that all application heads are supplied with glue from this line. However the glue supply unit can be located at any point of the glue supplying line so that the glue flow splits at the supply point, but from the supply point, the glue is supplied to the application heads serially. The glue supplying line preferably runs essentially in a direction orthogonal to the feed direction of the sheets so that all valves are supplied with glue as directly as possible.

It is particularly preferable if the glue supplying line is designed as a guide rail. For this purpose, the glue supplying line can be designed as a tube, which has boreholes in the region of the application heads so that the glue can be discharged there.

An advantageous embodiment of the present invention comprises guide elements, which guide the bag components to be glued in the region of the gluing station. The guide elements can be displaced together with the displaceable application head. In this manner it is ensured that the bag components take up a defined position relative to the application heads during the gluing process. Thus, for example it is possible to ensure that the bag components are firmly pressed onto the rollers conveying them.

BRIEF DESCRIPTION OF THE DRAWINGS

Additional advantageous embodiments of the present invention are specified in the graphic description, the drawings and the remaining claims. The individual figures illustrate:

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
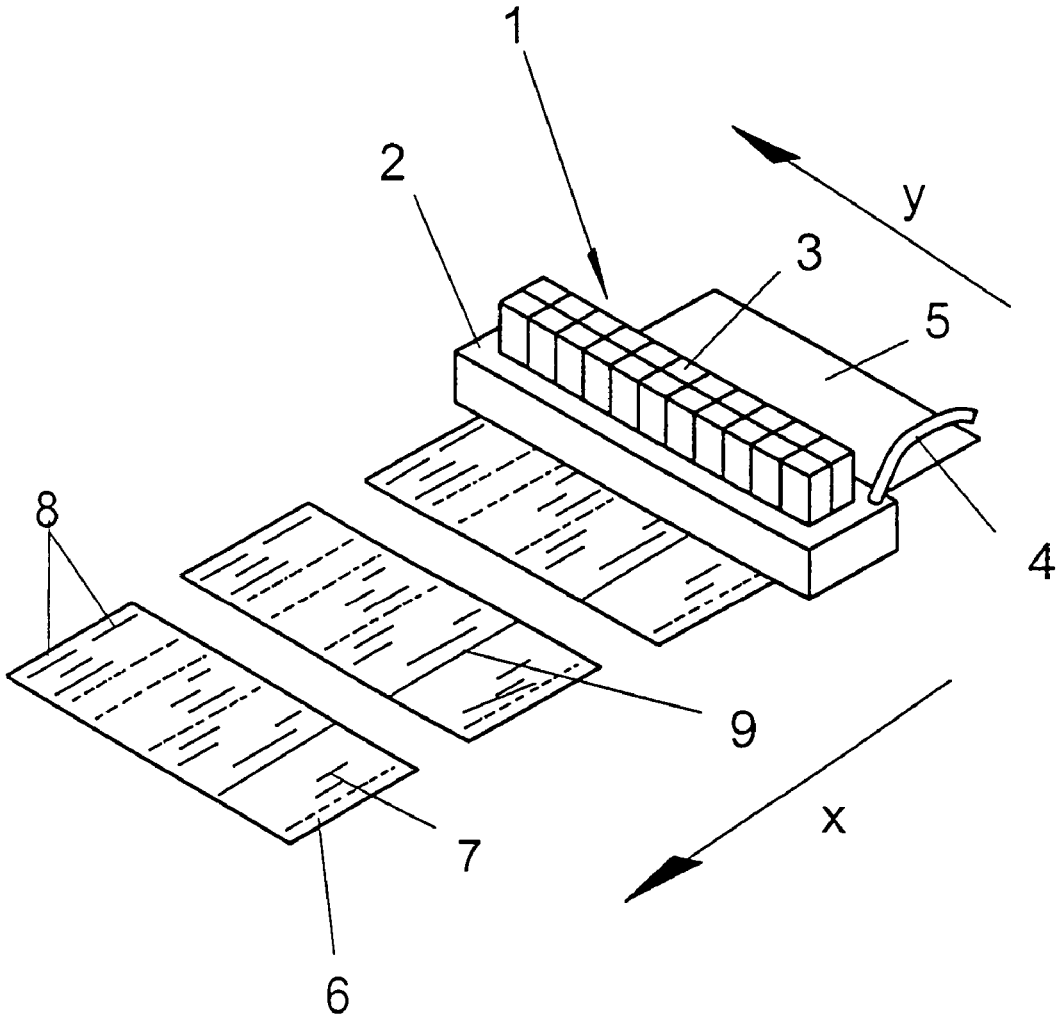
FIG. 1 an individual application head provided for the gluing station in the base insert device according to the present invention FIG. 2 an overview of the gluing station in the base insert device according to the present invention FIG. 3 view III-III illustrated in FIG. 2

FIG. 1 illustrates an application head 1, as is used in a gluing station in the base insert device according to the present invention. This application head 1 is composed of an application plate 2, to which valves 3 are attached. The glue is supplied to the application head 1 via the glue supplying line 4. Unglued sheets 5 are supplied to the gluing station in direction x.

Every valve 3 is provided with one glue outlet opening or a group of glue outlet openings in the side of the application plate 2 that is turned towards the unglued sheets 5. The glue flow to the glue outlet opening can be produced or interrupted by the assigned valve 3. In this manner it is possible to apply on the unglued sheet 5 different glue traces that run parallel to the feed direction x of the unglued sheets 5. By regularly opening and closing the valve 3, a regularly interrupted glue trace 6 can be applied. Likewise, it is possible to produce short glue traces 7 or interrupted glue traces 8 and continuous glue traces 9. If no unglued sheet 5 is located below the application head 1, then all the valves 3 interrupt the glue flow so that the gluing station is not contaminated unnecessarily. In order to be able to glue all the regions of the unglued sheets in the direction y perpendicular to the feed direction, the application head 1 can also be displaced in this direction. However, the application head 1 just described above can be used not only for gluing sheets 5, but also is suitable for applying glue on the regions of the subsequently formed bases of the bags to be glued due to the variability of the glue traces that can be produced.

Figure 2:
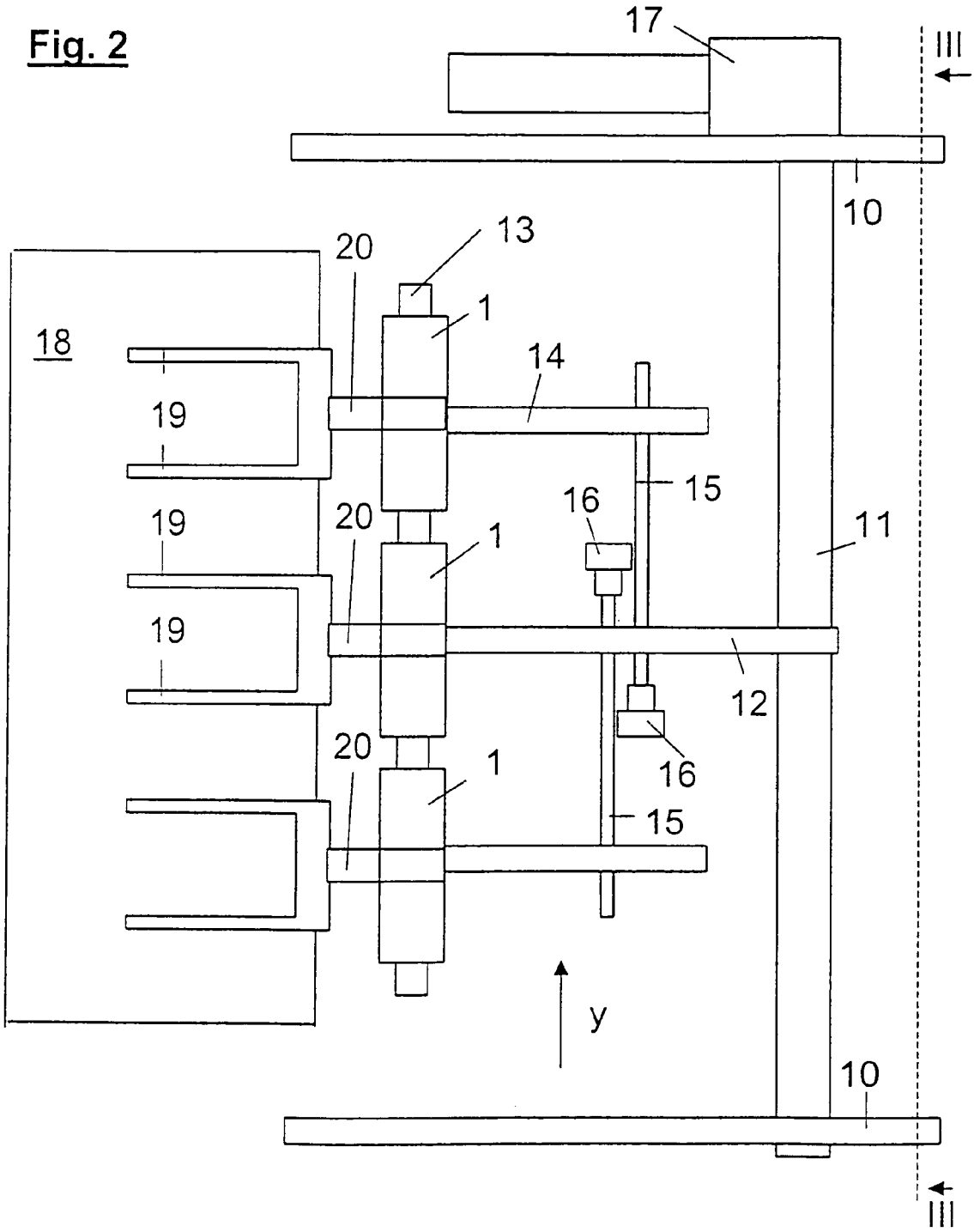
Figure 3:
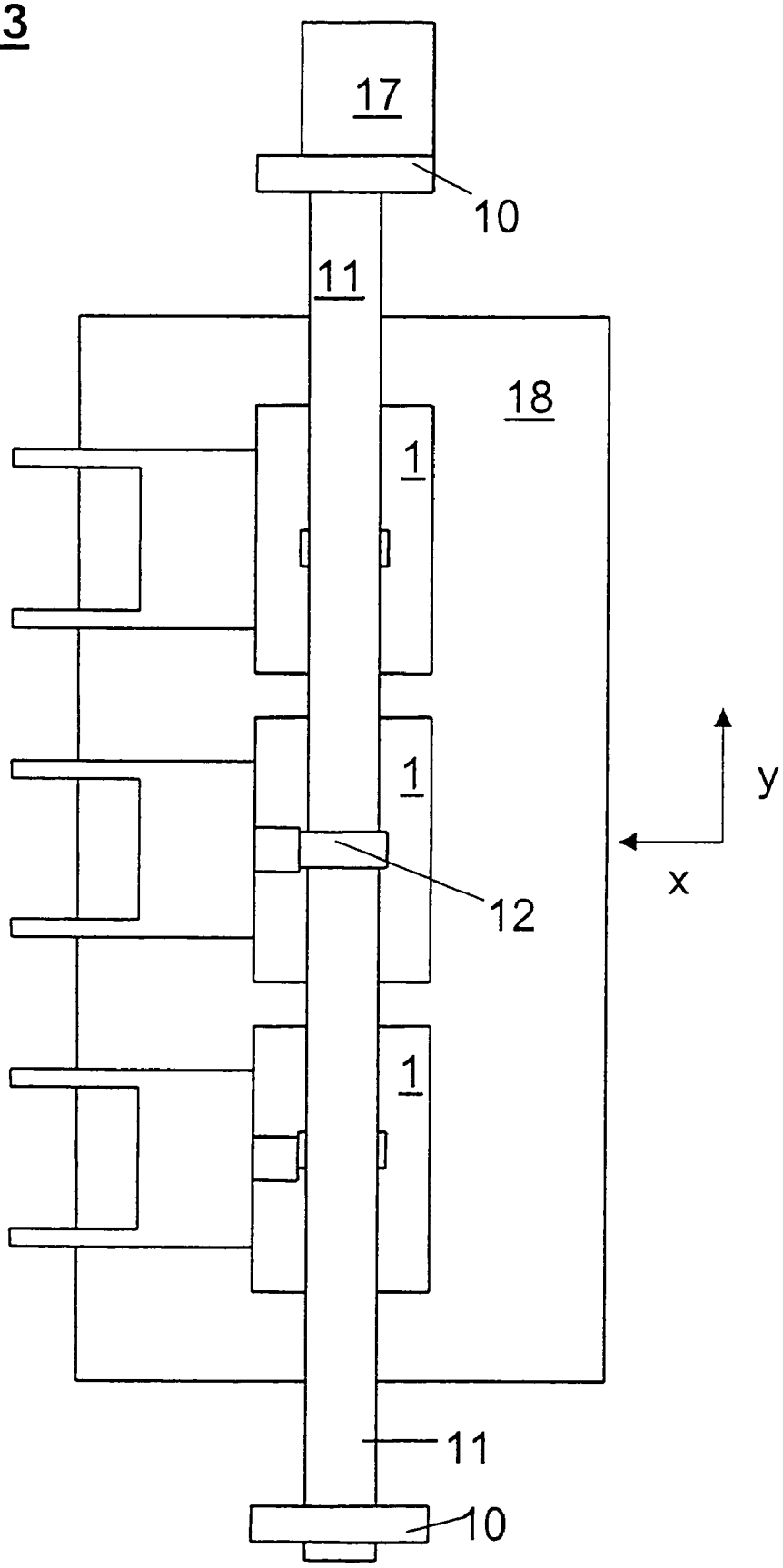

FIGS. 2 and 3 illustrate a gluing station in a base insert device according to the present invention in which three application heads 1 are provided. Both the outer application heads 1 can be supported on a guide rail 13 in such a way that they can be displaced in direction y. The middle application head 1 can be permanently connected to the guide rail 13. The guide rail 13 is attached using the supporting arm 12 to the rod 11, which in turn is supported in both the parts of the frame 10 such that it can be displaced in direction y. The rod 11 and with it the middle application head 1 are displaced by activating the drive 17, which can be a step motor, for example. Holders 14 are permanently attached to the outer application heads 1. The holders 14 contain threaded boreholes, which serve as spindle nuts and into which spindles 15 are screwed. The spindles 15 are supported in the supporting arm 12 in such a way that they are rotatable, though not displaceable. The spindles 15 are driven using drive units 16, which are connected to the supporting arm 12 in a manner that is not illustrated in detail. In this gluing station, the external application heads 1 can be moved independently of one another in such a way that, when seen in direction y, the outer edges of the sheets (not illustrated in these figures) can also be provided with glue. The sheets run on the roller 18 in the direction x (indicated in FIG. 3) and are held on this roller 18 by the guide elements 19. The guide elements 19 are connected using the holders 20 to the application heads 1 so that the guide elements 19 are also displaced along with the displacement of the application heads 1.

Figure 4:
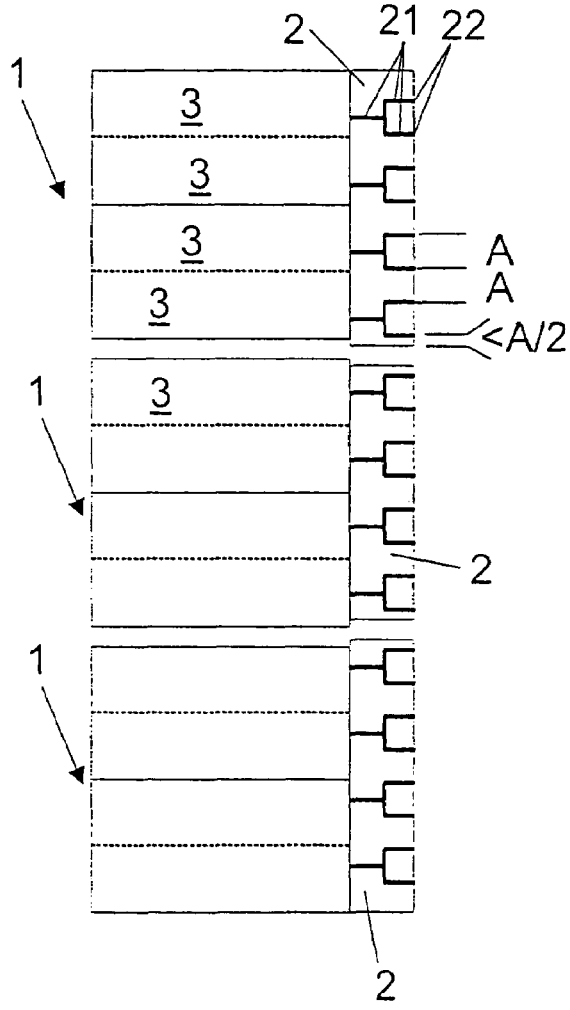
FIG. 4 schematic illustration of the application heads illustrated in FIGS. 2 and 3 in a position in which they are pulled apart from one another FIG. 5 schematic illustration of the three application heads illustrated in FIG. 4, however, in a position in which they travel together.
Figure 5:
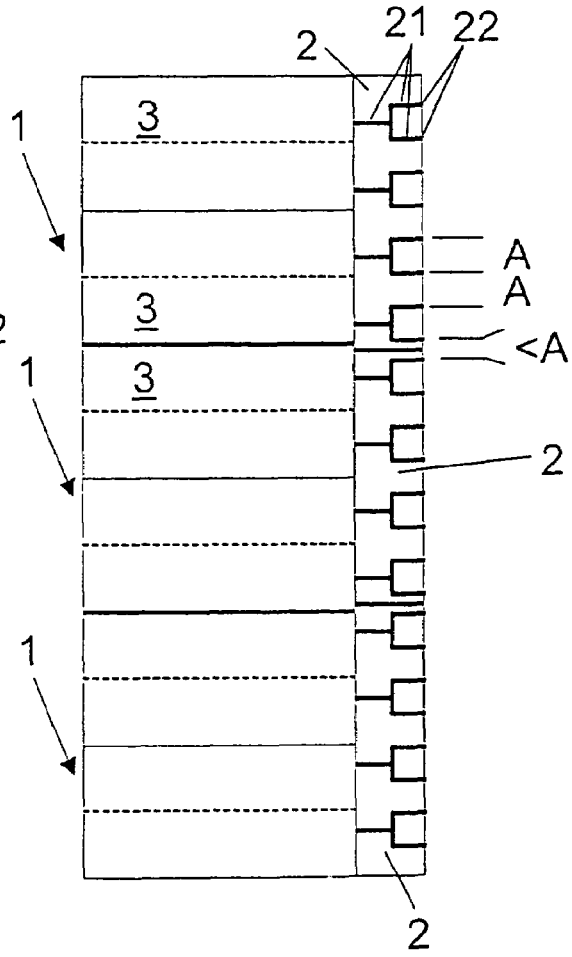

FIGS. 4 and 5 schematically illustrate the three application heads 1 illustrated in FIGS. 2 and 3. Of the application heads I, essentially the valves 3 can be seen, which are arranged on the application head 1 with practically no interspaces. Every valve 3 can deliver glue into the glue distribution channels 21 that are inserted into the application plate 2. The glue distribution channels 21 distribute the glue on two glue outlet openings 22. Naturally even a smaller or a larger number of glue outlet openings 22 can be provided, whereby however the glue discharge can be produced or interrupted simultaneously for all the glue outlet openings 22 assigned to a valve 3. The glue outlet openings 22 are arranged in such a way that they take up an equidistant distance A from one another.

The edges of the application plates 2 are trimmed down in such a way that the distance between these edges and the respective first glue outlet opening 22 is smaller than half the distance A. In addition, the application plates 2 of both the outer application heads 1 are attached in such a way that they can be easily displaced towards the middle application head 1. In this manner, in the position in which the application heads travel together, the distance between two adjoining glue outlet openings 22 that belong to two different application plates 2 is smaller than the distance A between the glue outlet openings 22 on an application plate 2. This situation is illustrated in FIG. 5. Using the illustrated embodiment, it is possible to move the application heads 1 apart from one another over a large adjustable range without requiring the adjoining glue outlet openings 22 belonging to two different application plates 2 to take up a larger distance than the distance A. Naturally it is also possible to move the application heads so far that the adjoining glue outlet openings 22 take up a larger distance than the distance A.

Figure 6A:
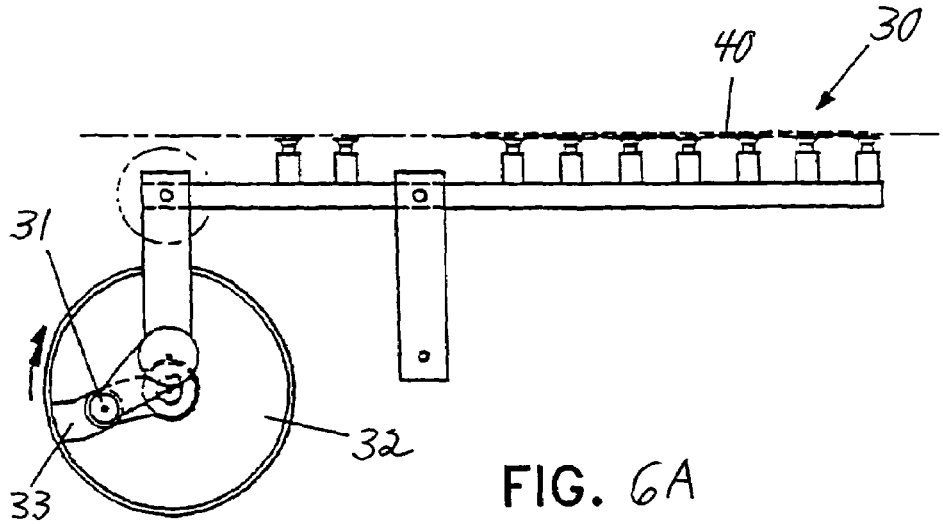
FIG. 6A is a schematic side view of a folding device of the present invention and shows a tubular section in a flat, unopened position on the device.
Figure 6B:
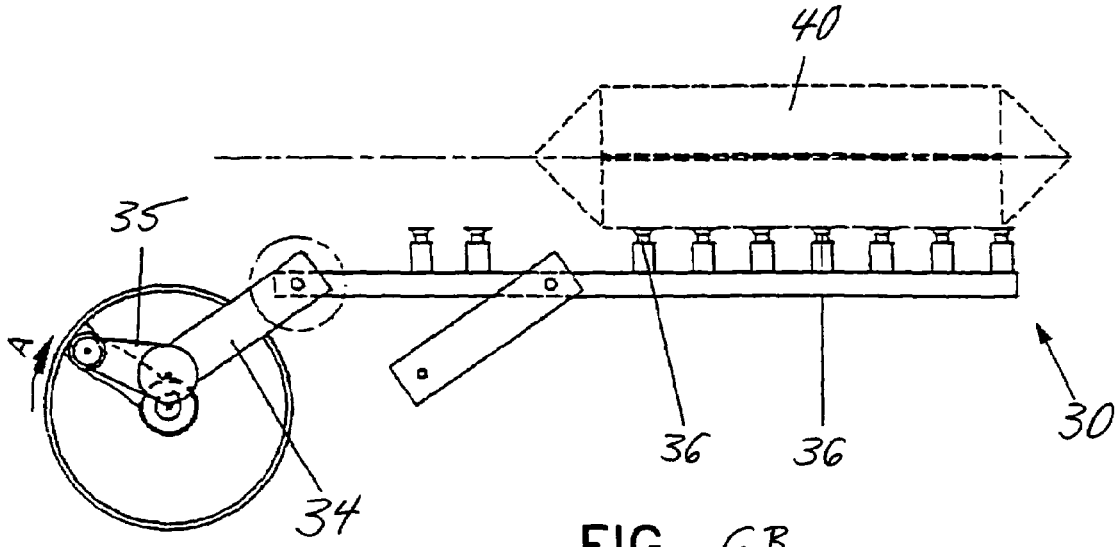
FIG. 6B is another schematic side view of the folding device shown in FIG. 6A and shows the tubular section in an opened position.

FIG. 6A is a schematic side view of a folding device 30 of the present invention and shows a tubular section 40 in a flat, unopened position on the device. FIG. 6B is another schematic side view of the folding device 30 shown in FIG. 6A and shows the tubular section 40 in an opened position. The folding device 30 has a roll 31, a disk 32, a guide 33, a connecting rod 34, a crank 35, and a plurality of suction units 36.

Figure 7:
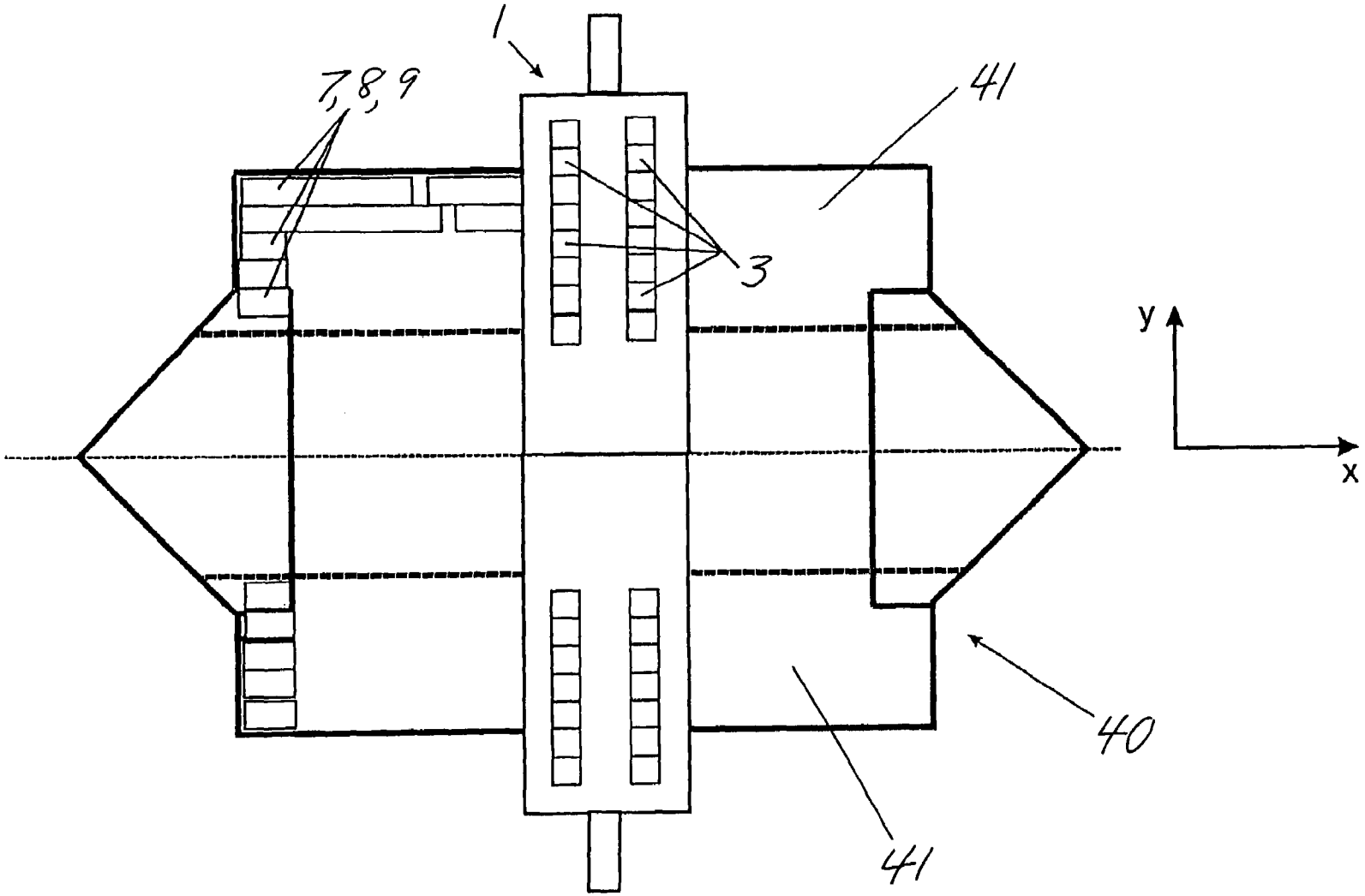
FIG. 7 is a schematic plan view of a glue application head and associated valves in accordance with the present invention.

FIG. 7 is a schematic plan view of the above-described glue application head 1 and the associated valves 3 in accordance with the present invention. By triggering (i.e., opening) the valves 3, the various glue traces 7, 8, 9 can be applied to the tubular section (i.e., opened bag bottom) 40.

Figure 8:
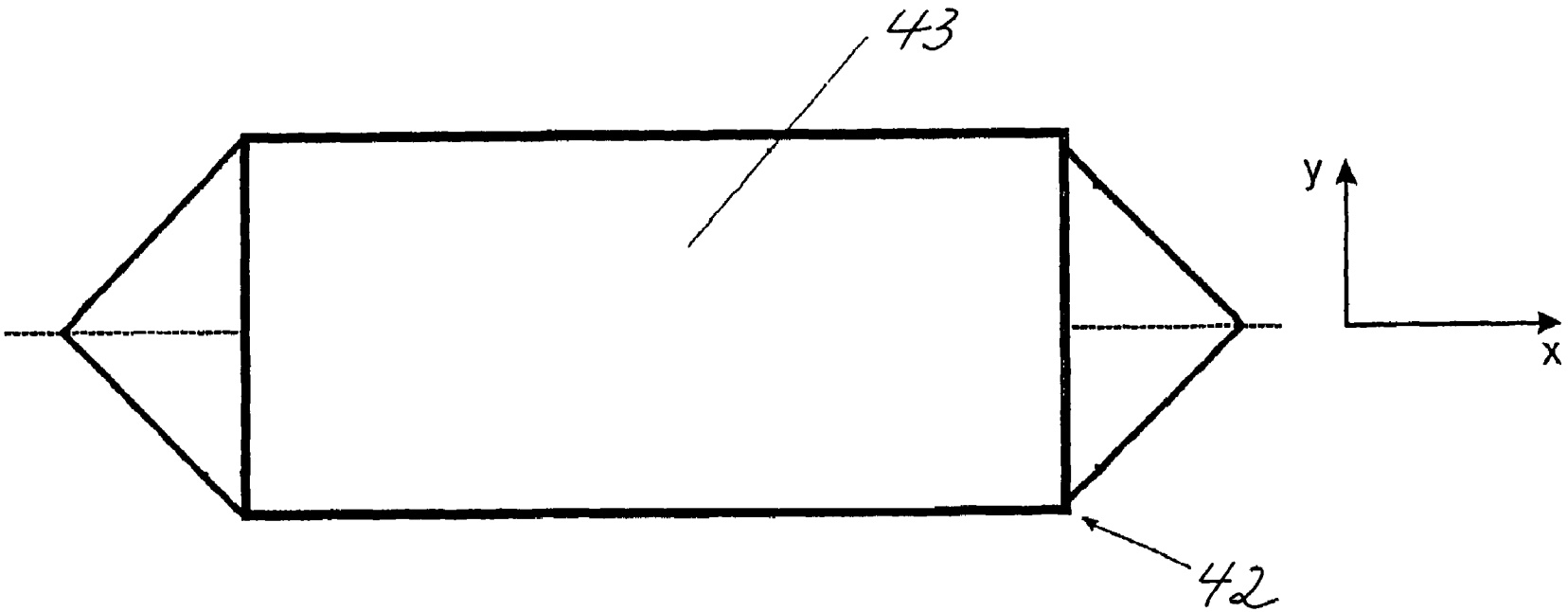
FIG. 8 is a schematic plan view of a glued and folded bag bottom formed in accordance with the present invention.

FIG. 8 is a schematic plan view of a glued and folded bag bottom formed in accordance with the present invention. After the opened bag bottom 40 is provided with the glue traces 7, 8, 9, the side gussets 41 (see FIG. 7) are folded onto the opened bag bottom 40. Then, the closed bag bottom 42 can be provided with a sheet 43. Before the sheet 43 is put onto the closed bag bottom 42, the sheet 43 is provided with glue.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of Reference Symbols

| | |
|---|---|
| 1 | Application head |
| 2 | Application plate |
| 3 | Valve |
| 4 | Glue supplying line |
| 5 | Unglued sheet |
| 6 | Regularly interrupted glue trace |
| 7 | Short glue trace |
| 8 | Interrupted glue trace |
| 9 | Continuous glue trace |
| 10 | Frame |
| 11 | Rod |
| 12 | Supporting arm |
| 13 | Guide rail |
| 14 | Holder |
| 15 | Spindle |
| 16 | Drive unit |
| 17 | Drive |
| 18 | Roller |
| 19 | Guide element |
| 20 | Support |
| 21 | Glue distribution channels |
| 22 | Glue outlet opening |
| A | Distance between two glue outlet openings 22 |
| x | Feed direction of the sheets |
| y | Direction perpendicular to the feed direction x of the sheets |

What is claimed is:

1. A base insert device for the formation of crossed bases in crossed base valve paper bags, said device comprising:

folding devices which introduce folds at ends of tubular sections from which the bags are produced;

one or more gluing stations, which apply glue to at least one of regions of the folds for gluing and sheets provided for gluing to the bases in the gluing stations; and at least one pressing station in which the folded bases and the sheets are brought into contact and glued, at least one of the gluing stations including glue outlet openings which may be selectively supplied with glue such that the selection of the glue outlet openings defines a format of the glue application, and said glue outlet openings being provided with at least two application heads of which at least one application head is displaceable with a head positioning device in a direction orthogonal to a feed direction of at least one of the sheets and the folded bases such that as a result of the displacement, a relative movement of the two application heads occurs, each of the application heads being provided with an application plate in which several glue outlet openings are each arranged equidistantly at a distance (A) on one line in a direction perpendicular to the feed direction of at least one of the sheets and the folds of the bases, the application plates being configured such that adjoining glue outlet openings of two different application heads are positionable with the head positioning device at a smaller distance than the distance (A).

2. The base insert device according to claim 1 wherein the two application heads are displaceably supported on a common guide rail.

3. The base insert device according to claim 2, wherein one of the application heads remains stationary with respect to the guide rail during the format adjustment.

4. The base insert device according to claim 3, wherein the format is defined by three application heads including a middle head that remains stationary with respect to the guide rail during the adjustment of the format.

5. The base insert device according to claim 1 further comprising at least one spindle drive that provides the force to move at least one of the displaceable application heads.

6. The base insert device according to claim 5 wherein the spindle is driven using a motor.

7. The base insert device according to claim 1 further comprising a device that automatically displaces the application head and a control unit that controls the displacement.

8. The base insert device according to claim 7 wherein a target image of the glue application is supplied to the control unit and the control unit calculates target positions of glue traces that are extruded from the glue outlet openings based on the target image.

9. The base insert device according to claim 7 wherein the device that automatically displaces the application head includes a spindle attached to an outer application head and a rod that supports the application heads in a frame, and said base insert device further comprising position sensors which record an actual position of the spindle and/or the rod and notify the control unit.

10. The base insert device according to claim 1 wherein all of the application heads of the gluing station are supplied with glue from one common glue supplying line.

11. The base insert device according to claim 10 wherein the glue supplying line extends in a direction substantially orthogonal to the feed direction of at least one of the sheets and the bases of the bags.

12. The base insert device according to claim 10 wherein the glue supplying line is configured as a guide rail.

13. The base insert device according to claim 1 further comprising guide elements which guide bag components to be glued in the region of the gluing station, the guide elements being displaceable together with the displaceable application head.

14. The base insert device according to claim 1, wherein the gluing stations and the glue outlet openings are configured to apply a starch glue.

15. The base insert device according to claim 1, wherein the glue is a starch glue.

16. A base insert device that forms a crossed base in a crossed base valve paper bag comprises:

a folding device that introduces folds at a base end of a bag section;

a gluing station that applies glue to at least one of the folds that are to be glued and a sheet that is to be glued to the base end, the gluing station including at least two application heads having a plurality of glue outlet openings that are selectively supplied with glue such that the selected openings define a format of the glue application, at least one of the application heads being displaceable with a head positioning device in a direction orthogonal to a feed direction of at least one of the folded bag section and the sheet such that as a result of the displacement, a relative movement between the two application heads occurs, each of the application heads being provided with an application plate in which several glue outlet openings are each arranged equidistantly at a distance (A) on one line in a direction perpendicular to the feed direction of at least one of the sheets and the folds of the bases, the application plates being configured such that adjoining glue outlet openings of two different application heads are positionable with the head positioning device at a smaller distance than the distance (A); and a pressing station that contacts the applied glue, the folded base end, and the sheet so as to form the crossed base.

17. The base insert device according to claim 16, wherein the head is displaceable such that a separation distance between a glue outlet opening of a first head and a glue outlet opening of a second head is less than a distance between adjacent glue outlet openings on each of the heads.

18. A base insert device that forms a crossed base in a crossed base valve paper bag comprises:

a folding device that introduces folds at a base end of a bag section;

a gluing station that applies glue to at least one of the folds that are to be glued and a sheet that is to be glued to the base end, the gluing station including at least two application heads with at least one of the application heads being displaceable with a head positioning device in a direction orthogonal to a feed direction of at least one of the folded bag section and the sheet such that as a result of the displacement a relative movement between the two application heads occurs, and each application head having an application plate that includes a plurality of glue outlet openings arranged linearly and equidistantly at a distance (A) in a direction perpendicular to the feed direction of at least one of the folded bag section and the sheet, the application plates being configured such that adjacent glue outlet openings of two different application heads are positionable with the head positioning device at a smaller distance than the distance (A); and a pressing station that contacts the applied glue, the folded base end, and the sheet so as to form the crossed base.

* * * * *